US008736650B2

(12) United States Patent
Bouverie et al.

(10) Patent No.: US 8,736,650 B2
(45) Date of Patent: May 27, 2014

(54) PRINT STATION

(75) Inventors: William M. Bouverie, Windermere, FL (US); Mark Allen Hitz, Rock Hill, SC (US); Marjorie Hitz, legal representative, Rock Hill, SC (US); Richard Hatle, Oviedo, FL (US); Dwayne Steven Tobin, Longwood, FL (US)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 13/530,564

(22) Filed: Jun. 22, 2012

(65) Prior Publication Data

US 2012/0327168 A1 Dec. 27, 2012

Related U.S. Application Data

(60) Provisional application No. 61/500,269, filed on Jun. 23, 2011.

(51) Int. Cl.
*B41J 2/32* (2006.01)

(52) U.S. Cl.
USPC ..... 347/218

(58) Field of Classification Search
USPC ..... 347/171, 172, 174, 176, 197, 218; 400/191, 225, 235.1, 236, 236.1, 400/236.2, 237, 679, 691–693
See application file for complete search history.

(56) References Cited

U.S. PATENT DOCUMENTS

| | | | |
|---|---|---|---|
| 4,143,977 | A | 3/1979 | Kurihara et al. |
| 4,177,731 | A | 12/1979 | Kleist et al. |
| 4,788,558 | A | 11/1988 | Caldwell et al. |
| 4,788,559 | A | 11/1988 | Ende |
| 4,872,659 | A | 10/1989 | Kato et al. |
| 4,924,240 | A | 5/1990 | Herbert et al. |
| 4,991,846 | A | 2/1991 | Sondej |
| 5,028,155 | A | 7/1991 | Sugiura et al. |
| 5,087,137 | A | 2/1992 | Burnard et al. |
| 5,206,662 | A | 4/1993 | Fox et al. |
| 5,326,182 | A | 7/1994 | Hagstrom |
| 5,397,192 | A | 3/1995 | Khormaee |

(Continued)

FOREIGN PATENT DOCUMENTS

JP 04552558 B2 9/2010

OTHER PUBLICATIONS

Written Opinion of the International Searching Authority, PCT/US2012/036297, Jul. 17, 2012.

(Continued)

*Primary Examiner* — Huan Tran
(74) *Attorney, Agent, or Firm* — Carter, DeLuca, Farrell & Schmidt, LLP

(57) ABSTRACT

A print station system (1) having a drive-stepper motor (2), platen rollers (3, 4) in operative communication with the drive-stepper motor (2), a pinch roller (10) in operative communication with the drive-stepper motor (2), a top-of-form sensor (11) located between the platen roller (3, 4) and the pinch roller (10), a rocker arm (12) in operative communication with the platen roller (3, 4) and the pinch roller (10), and a printhead assembly (5), a media guide (12*a*, 12*b*). A radio-frequency identification antenna (16) or a receptacle (15) for holding same may be located between the platen roller (3, 4) and the pinch roller (10).

20 Claims, 9 Drawing Sheets

(56) References Cited

U.S. PATENT DOCUMENTS

| | | | | |
|---|---|---|---|---|
| 5,468,076 | A | 11/1995 | Hirano et al. | |
| 5,490,638 | A | 2/1996 | Driftmyer et al. | |
| 5,564,841 | A | 10/1996 | Austin et al. | |
| 5,600,350 | A | 2/1997 | Cobbs et al. | |
| 5,650,730 | A | 7/1997 | Herbst, Jr. | |
| 5,684,516 | A | 11/1997 | Cseledy et al. | |
| 5,790,162 | A | 8/1998 | Adams et al. | |
| 5,820,280 | A | 10/1998 | Fox | |
| 5,836,704 | A | 11/1998 | Lau et al. | |
| 5,870,114 | A | 2/1999 | Numata et al. | |
| 5,872,585 | A | 2/1999 | Donato et al. | |
| 5,874,980 | A | 2/1999 | West | |
| 5,909,233 | A | 6/1999 | Hamman et al. | |
| 5,927,875 | A | 7/1999 | Lau et al. | |
| 5,978,004 | A | 11/1999 | Ehrhardt | |
| 5,995,128 | A | 11/1999 | Adams et al. | |
| 6,014,229 | A | 1/2000 | Yun | |
| 6,020,906 | A | 2/2000 | Adams et al. | |
| 6,034,708 | A | 3/2000 | Adams et al. | |
| 6,039,481 | A * | 3/2000 | Ham | 400/708 |
| 6,057,870 | A | 5/2000 | Monnier et al. | |
| 6,070,048 | A | 5/2000 | Nonaka et al. | |
| 6,082,914 | A | 7/2000 | Barrus et al. | |
| 6,095,704 | A | 8/2000 | Jaeger et al. | |
| 6,099,178 | A | 8/2000 | Spurr et al. | |
| 6,129,463 | A | 10/2000 | Lau et al. | |
| 6,201,255 | B1 | 3/2001 | Torchalski et al. | |
| 6,283,024 | B1 | 9/2001 | George | |
| 6,289,730 | B1 | 9/2001 | Elgee | |
| 6,302,604 | B1 | 10/2001 | Bryant et al. | |
| 6,389,241 | B1 | 5/2002 | Cernusak et al. | |
| 6,396,070 | B1 | 5/2002 | Christensen et al. | |
| 6,520,614 | B2 | 2/2003 | Kaneko | |
| 6,616,362 | B2 | 9/2003 | Bouverie et al. | |
| 6,825,864 | B2 | 11/2004 | Botten et al. | |
| 6,840,689 | B2 | 1/2005 | Barrus et al. | |
| 6,846,121 | B2 | 1/2005 | Bouverie et al. | |
| 6,857,714 | B2 | 2/2005 | Hohberger et al. | |
| 6,900,449 | B2 | 5/2005 | Bolash et al. | |
| 6,942,403 | B2 | 9/2005 | Hohberger et al. | |
| 7,042,478 | B2 | 5/2006 | Bouverie et al. | |
| 7,071,961 | B2 | 7/2006 | Ullenius et al. | |
| 7,079,168 | B2 | 7/2006 | Ullenius et al. | |
| 7,150,572 | B2 | 12/2006 | McNestry et al. | |
| 7,162,460 | B2 | 1/2007 | Cleckler et al. | |
| 7,205,561 | B2 | 4/2007 | Chelvayohan et al. | |
| 7,255,343 | B2 | 8/2007 | So | |
| 7,375,832 | B2 | 5/2008 | Bouverie et al. | |
| 7,456,995 | B2 | 11/2008 | Stephens | |
| 7,502,042 | B2 | 3/2009 | Hitz et al. | |
| 7,537,404 | B2 | 5/2009 | Bouverie et al. | |
| 7,600,684 | B2 | 10/2009 | Tobin et al. | |
| 7,667,874 | B2 | 2/2010 | MacDonald et al. | |
| 7,695,129 | B2 * | 4/2010 | Yoshikawa et al. | 347/104 |
| 7,699,550 | B2 | 4/2010 | Bouverie et al. | |
| 7,824,116 | B2 | 11/2010 | Lyman | |
| 7,845,632 | B2 | 12/2010 | Windsor et al. | |
| 7,857,414 | B2 | 12/2010 | Eun et al. | |
| 7,876,223 | B2 | 1/2011 | Yamaguchi et al. | |
| 7,891,892 | B2 | 2/2011 | Chiu | |
| 7,907,159 | B2 | 3/2011 | Matsuo et al. | |
| 7,934,881 | B2 | 5/2011 | Lodwig et al. | |
| 7,938,501 | B2 | 5/2011 | Takamiya et al. | |
| 8,142,087 | B2 | 3/2012 | Kugimachi | |
| 2001/0008612 | A1 | 7/2001 | Liljestrand et al. | |
| 2003/0081024 | A1 | 5/2003 | Vives et al. | |
| 2003/0141655 | A1 | 7/2003 | Bryer | |
| 2004/0008365 | A1 | 1/2004 | Hobbs | |
| 2004/0114024 | A1 | 6/2004 | Bouverie et al. | |
| 2004/0165927 | A1 | 8/2004 | Fisher et al. | |
| 2005/0002715 | A1 | 1/2005 | Fries et al. | |
| 2005/0189693 | A1 | 9/2005 | Ko | |
| 2005/0190368 | A1 | 9/2005 | Ehrhardt, Jr. et al. | |
| 2005/0204940 | A1 | 9/2005 | Elliott et al. | |
| 2006/0007295 | A1 | 1/2006 | Ueda | |
| 2006/0045601 | A1 | 3/2006 | Endo | |
| 2006/0055721 | A1 | 3/2006 | Burdette et al. | |
| 2006/0157911 | A1 | 7/2006 | Learmonth et al. | |
| 2006/0159504 | A1 | 7/2006 | Blanchard, Jr. et al. | |
| 2006/0180737 | A1 | 8/2006 | Consiglio | |
| 2007/0022233 | A1 | 1/2007 | Bridges et al. | |
| 2007/0040326 | A1 | 2/2007 | Noda et al. | |
| 2007/0059078 | A1 | 3/2007 | Silverbrook et al. | |
| 2007/0138738 | A1 | 6/2007 | Motohashi et al. | |
| 2009/0038495 | A1 | 2/2009 | Butzen et al. | |
| 2009/0103806 | A1 | 4/2009 | Nakami | |
| 2009/0244584 | A1 | 10/2009 | McGarry et al. | |
| 2010/0066782 | A1 | 3/2010 | Yamamoto et al. | |
| 2010/0169513 | A1 | 7/2010 | Levin | |
| 2010/0247222 | A1 | 9/2010 | Bouverie et al. | |
| 2010/0319561 | A1 | 12/2010 | Colquitt et al. | |
| 2011/0042883 | A1 | 2/2011 | Wang et al. | |
| 2011/0132643 | A1 | 6/2011 | Hattori et al. | |

OTHER PUBLICATIONS

Written Opinion of the International Searching Authority, PCT/US2012/039043, Aug. 3, 2012.
Written Opinion of the International Searching Authority, PCT/US2012/041093, Aug. 7, 2012.
Written Opinion of the International Searching Authority, PCT/US2012/043734, Sep. 21, 2012.
Written Opinion of the International Searching Authority, PCT/US2012/043709, Sep. 21, 2012.
Written Opinion of the International Searching Authority, PCT/US2012/043772, Sep. 14, 2012.
Written Opinion of the International Searching Authority, PCT/US2012/046712, Oct. 5, 2012.
Written Opinion of the International Searching Authority, PCT/US2012/049417, Nov. 2, 2012.
Written Opinion of the International Searching Authority, PCT/US2012/050938, Nov. 6, 2012.
Written Opinion of the International Searching Authority, PCT/US2012/060956, Jan. 11, 2013.
Written Opinion of the International Searching Authority, PCT/US2012/066291, Feb. 5, 2013.

* cited by examiner

PRINT STATION

CROSS-REFERENCE TO RELATED APPLICATION(S)

This application claims priority to provisional patent application No. 61/500,269, filed Jun. 23, 2011, and entitled "PRINT STATION", the contents of which are incorporated in full by reference herein.

FIELD OF INVENTION

The present invention generally relates to the field of image forming apparatus and devices, and in particular, to a print station used in a thermal transfer printing system.

BACKGROUND

Printing systems such as copiers, printers, facsimile devices or other systems having a print engine for creating visual images, graphics, texts, etc. on a page or other printable medium typically include various media feeding systems for introducing original image media or printable media into the system. Examples include thermal transfer printers. Typically, a thermal transfer printer is a printer which prints on media by melting a coating of ribbon so that it stays glued to the media on which the print is applied. It contrasts with direct thermal printing where no ribbon is present in the process. Typically, thermal transfer printers comprise a supply spindle operable for supplying a media web and ribbon, a print station, and a take up spindle. New ribbon and media is fed from the supply spindle to the print station for printing and then the ribbon is wound up by the take up spindle while the media is exited from the print station.

Problems with current printing systems, however, include within the print station alignment and compression issues which may result in faulty or defective printing. Additionally, the ability to maintain a tight media web in the print station has been identified as a problem in conventional print stations. Finally, media movement during a printing operation has been identified as an issue within print stations which could be improved.

Accordingly, it would be desirable to provide a print station operable for use within a thermal transfer printing system which compensates for alignment and compression issues. Additionally, it would be desirable to provide a print station which has the ability to maintain a tight media web. Finally, it would be desirable to provide a print station that is configured to limit media movement.

SUMMARY OF THE INVENTION

The present invention is designed to overcome the deficiencies and shortcomings of the systems and devices conventionally known and described above. The present invention is designed to reduce the manufacturing costs and the complexity of assembly. In all exemplary embodiments, the present invention provides a print station that may be utilized in conjunction with a variety of printers and various media types and sizes and which overcomes the noted shortcomings of existing systems by combining with a novel "stand alone" print station having various options containing features which expand the overall functionality of the printing system.

In all exemplary embodiments, the print station of the present invention generally includes a drive-stepper motor; a platen roller in operative communication with the drive-stepper motor; a pinch roller in operative communication with the drive-stepper motor; a top-of-form sensor located between the platen roller and the pinch roller, wherein the top-of-form sensor allows for sensing of indicators on a media; a rocker arm in operative communication with the platen roller and the pinch roller; a printhead assembly having: a thermal printhead, a compression spring, and a printhead pressure adjustment sensor in communication with the compression spring; a media guide having media loading sensors in communication with the printhead pressure adjustment assembly for guiding the media into the print station; a radio-frequency identification antenna substantially located between the main platen roller and the pinch roller; a power source in communication with the print station; a controller circuit card assembly in communication with the print station; and a pair of adjustable media guides connected about a base of the print station, the media guides being axially spaced apart along the length of the base and being configured and adapted such that they can be manipulated or moved along a horizontal axis of the base in a sliding manner and in a synchronized manner. IN example embodiments, the pair of media guides include a sensor affixed to the base, the sensor being operable for emitting at least one light beam through at least one aperture located in the base, wherein at least one of the media guides are provided with a tab or other obstruction which is operable for protruding into the path of at least one of the light beams emitted from the sensor at defined locations, thereby signaling the sensor and the printer of the media's width.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof.

BRIEF DESCRIPTION OF THE DRAWINGS

The present subject matter may take form in various components and arrangements of components, and in various steps and arrangements of steps. The appended drawings are only for purposes of illustrating exemplary embodiments and are not to be construed as limiting the subject matter.

DETAILED DESCRIPTION OF THE EMBODIMENTS

The present invention will now be described more fully hereinafter with reference to the accompanying drawings in which exemplary embodiments of the invention are shown. However, this invention may be embodied in many different forms and should not be construed as limited to the embodiments set forth herein. These exemplary embodiments are provided so that this disclosure will be both thorough and complete, and will fully convey the scope of the invention to those skilled in the art. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 1:
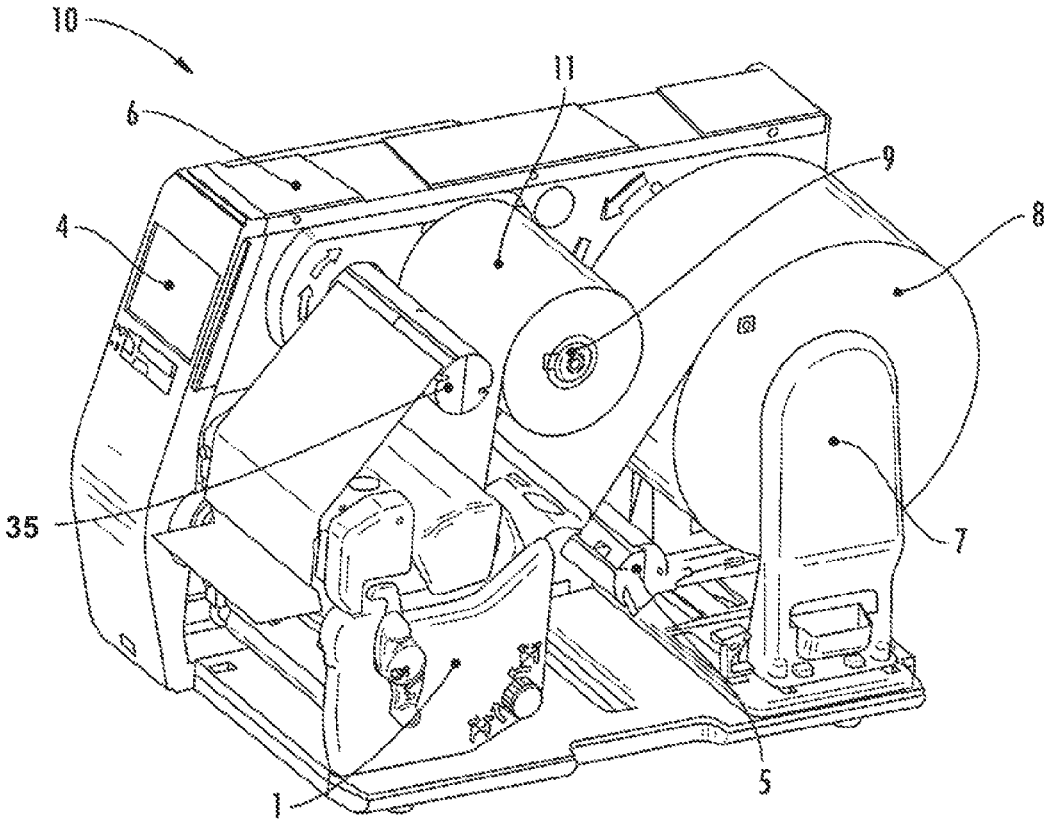
FIG. 1 is a front perspective view of a print station system constructed in accordance with one example embodiment of the present disclosure.
Figure 2:
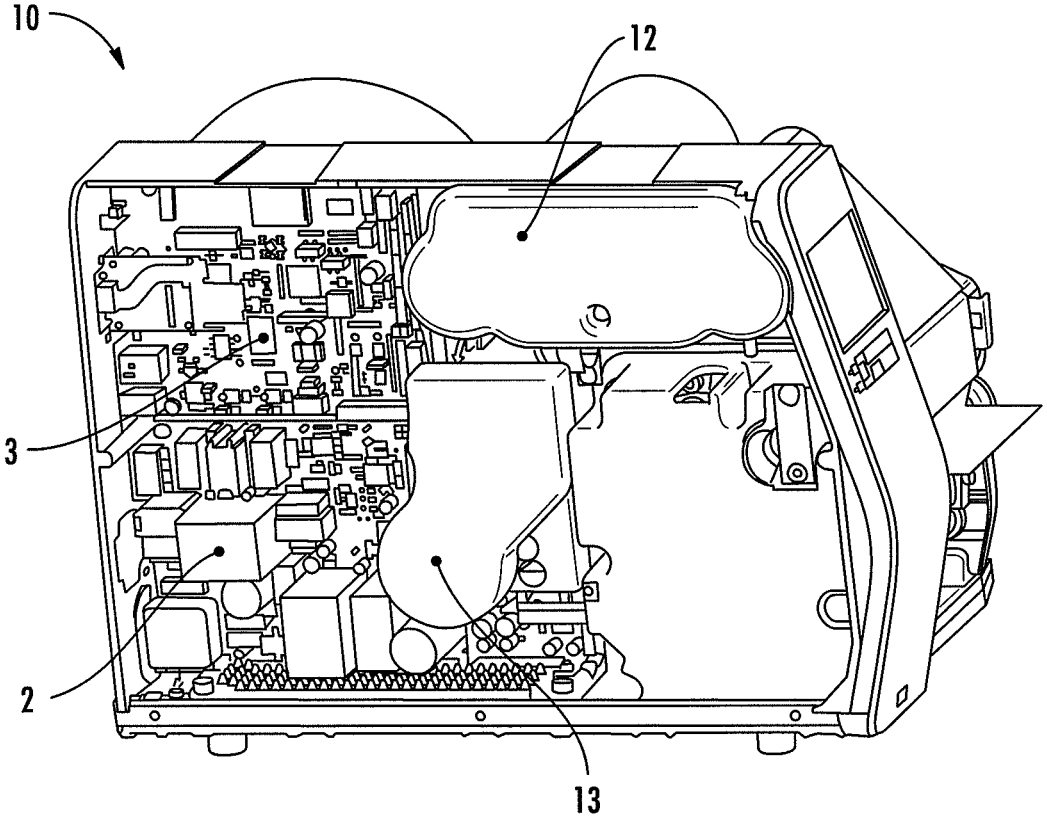
FIG. 2 is a rear perspective view of the embodiment of FIG. 1.

Referring now to the drawings, FIGS. 1 and 2 are varying views of an exemplary embodiment of a print station system 10 which is used as part of the printing system of the present invention. The print station system 10 may include a print station 1, a power source 2 in operative communication with the print station system 10 components, a controller circuit card assembly 3, a display panel 4, and a media rewind hub 5 in a printer chassis 6. The print station system 10 may also include a media hanger/hub 7 for housing a media supply roll 8, a ribbon supply hub 9 for holding a ribbon supply roll 11, and a ribbon take up hub 35.

The power source 2 may be of any type or configuration including, but not limited to, an external power source, an internal power source, alternative current, direct current, battery, etc. The power source 2 provides a sufficient amount of power to operate the print station system 10.

The display panel 4 is in operative communication with the print station 1 and may be of any type and configuration. By way of non-limiting example, the display panel may be liquid crystal display (LCD), plasma, or any other type. Moreover, the display panel 4 may be touch activated. Additionally or in the alternative, the display panel 4 may be operatively connected to at least one button or other input wherein a user may input data or other information into the print station system 10. Moreover, the display panel 4 may be secured on or within the chassis 6, connected to the print station 1, or otherwise be placed in communication with the print station 1.

Figure 3:
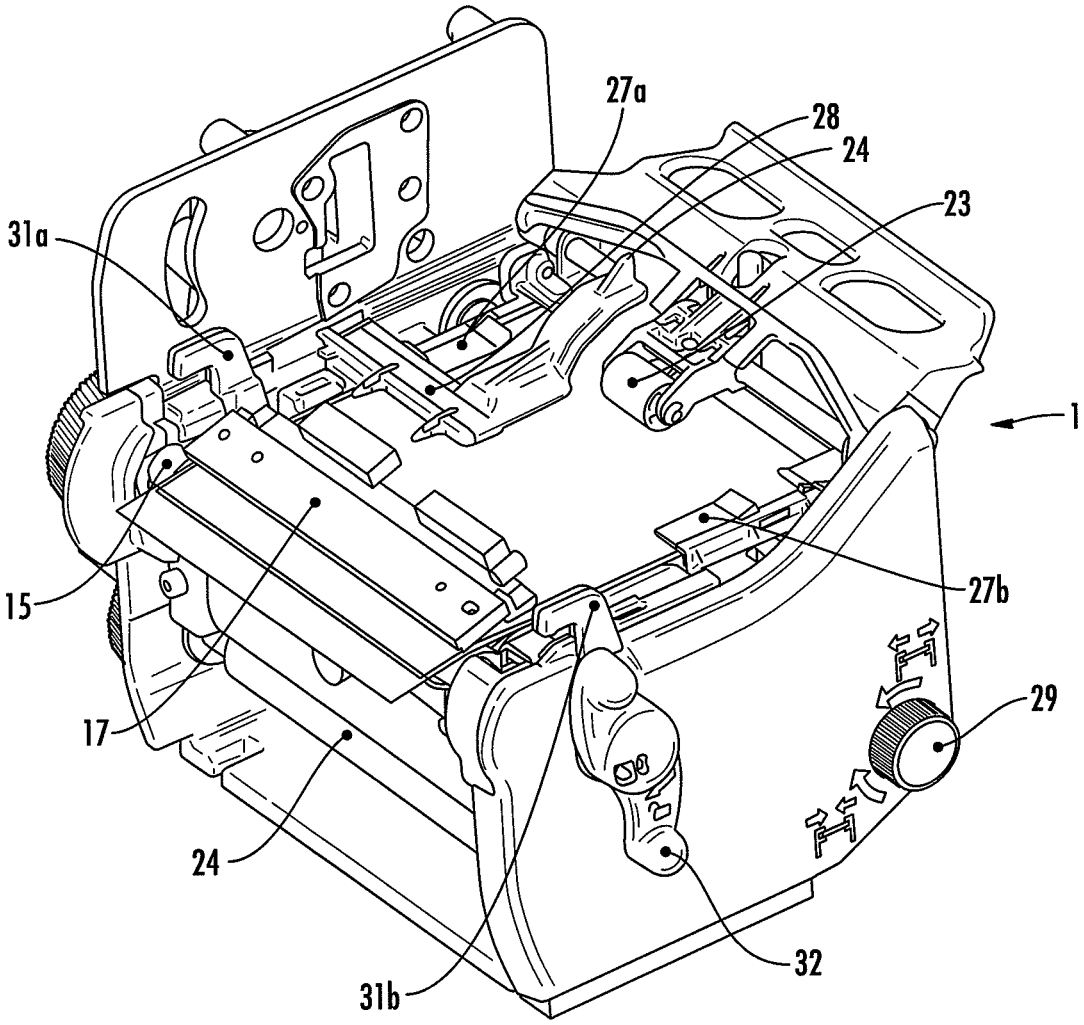
FIG. 3 is a perspective front view of a print station with a printhead assembly removed constructed in accordance with one example embodiment of the present disclosure.
Figure 4:
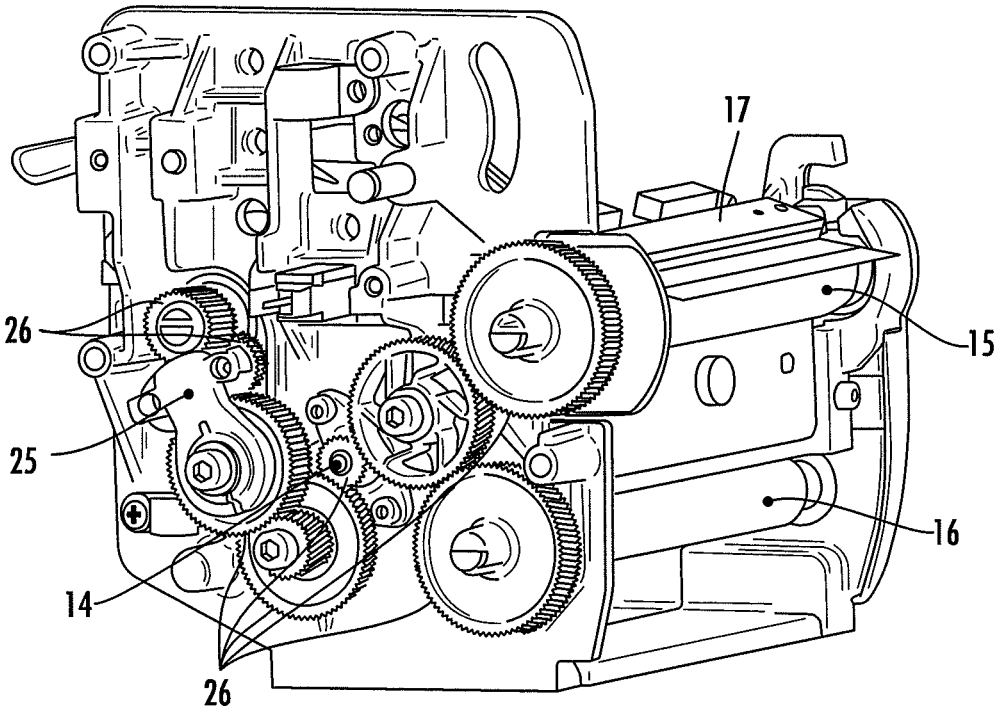
FIG. 4 is a perspective side view of the embodiment of FIG. 3.

The display panel 4 may be used to adjust all printing parameters of the print station system 10. Such parameters include, but are not limited to, print location on the media, control of the top-of-form sensor 24 (FIGS. 3 and 8), and enabling or disabling optional features. Further, the display panel 4 may be used to adjust the torque of the motors in the ribbon drive assembly 12 and media rewinder assembly 13 for unique media. The display panel 4 may also be used to adjust the amount of power delivered to each element of a printhead assembly 17 in the print station 1 from the power source 2.

The printer chassis 6 may provide a proper grounding for the electronic components of the print station system 10. Additionally, the chassis 6 may provide a structurally sound frame and housing for mounting components of the print station system 10.

The print station system 10 includes and aligns a media hanger/hub 7 with the print station 1. As a non-limiting example, a center of the media hanger/hub 7 may be aligned with a center of the print station 1.

Print station media width sensors may measure the width of the media passing through the print station system 10 via the controller circuit card assembly 3. The media width information may be relayed to a ribbon drive assembly 12, which may then adjust the torque of drive motors in proportion to the width of the media. The media width information may also be relayed to a media rewinder assembly 13, which adjusts the torque of a motor in proportion to the width of the media.

Referring now to FIGS. 3-7, varying views of a print station 1 which is constructed in accordance with an example embodiment of the present disclosure is shown. The print station 1 generally includes a motor 14, a main platen roller 15, a lower platen roller 16, and a printhead assembly 17. The print station 1 may be easily inserted, removed from or otherwise incorporated into or integrated with a larger printer as desired, thereby permitting additional capabilities, functions, and options other than or in addition to those features provided by the print station 1. Thus, it will be appreciated by those skilled in the art that the print station 1 of the present invention is a "stand alone" device.

Figure 5:
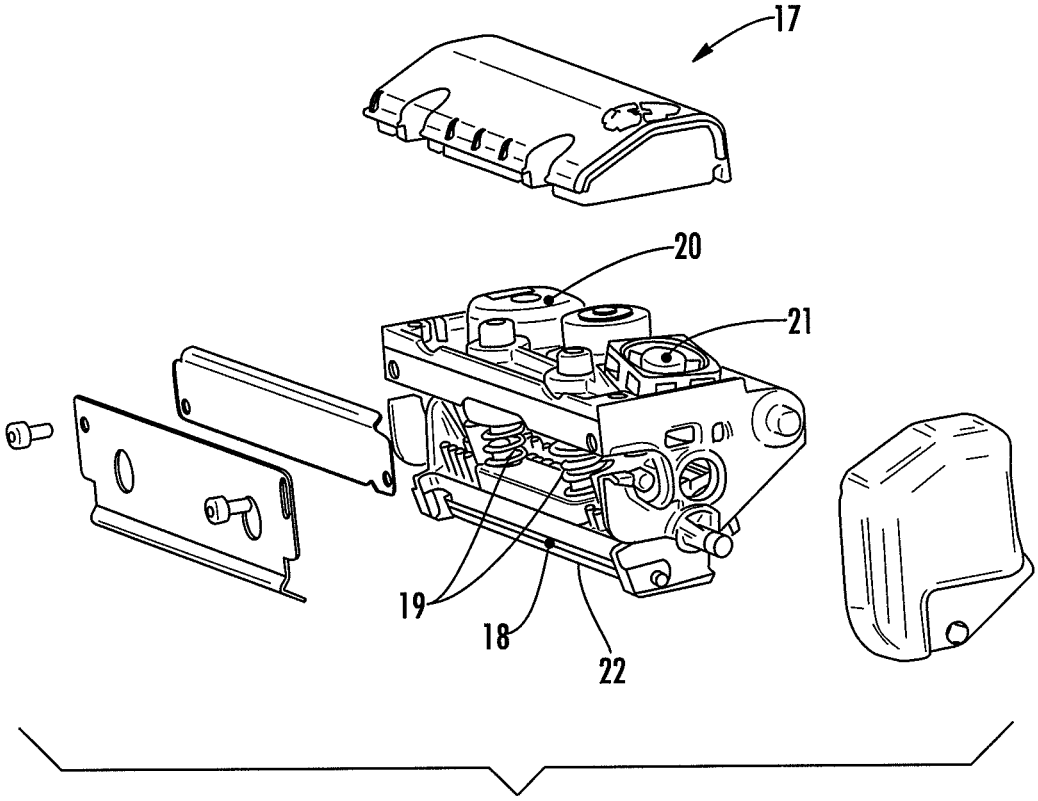
FIG. 5 is an exploded view of a printhead assembly constructed in accordance with one example embodiment of the present disclosure.
Figure 6:
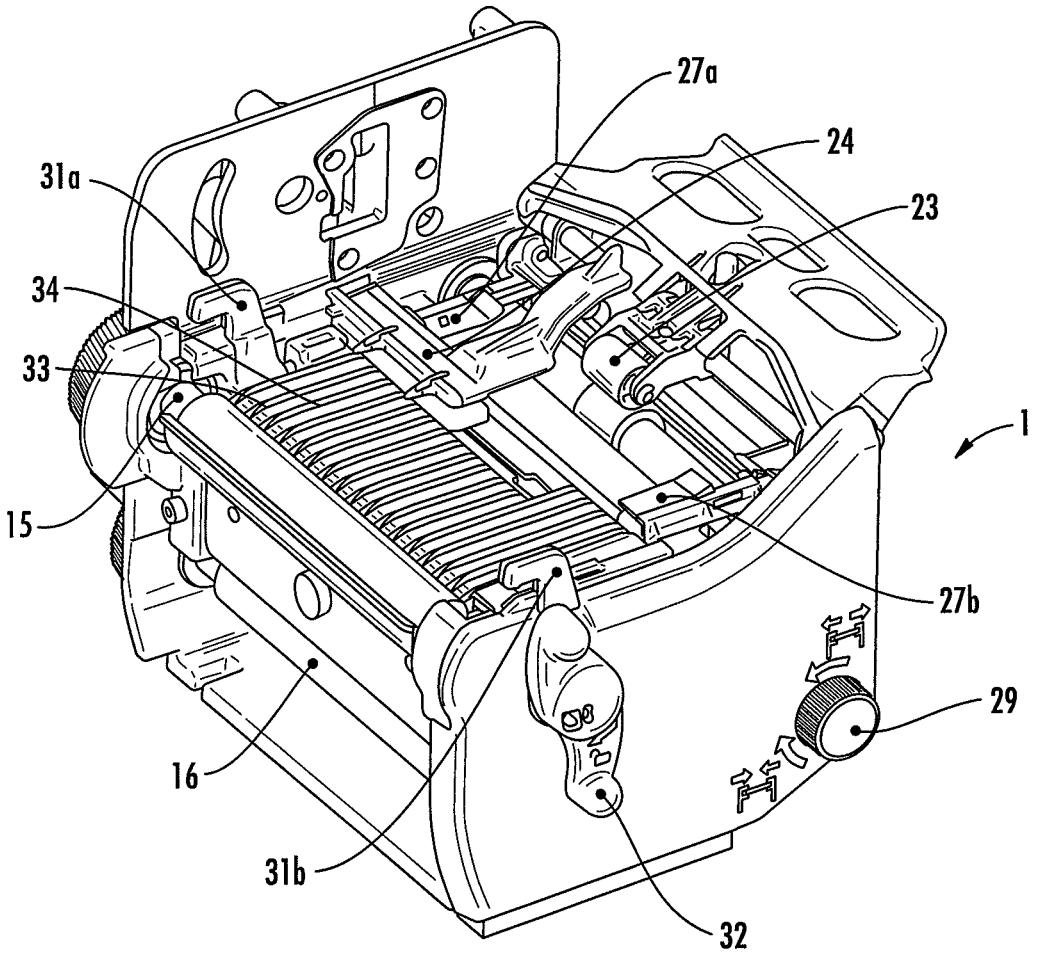
FIG. 6 is a perspective view of a print station with an RFID receptacle and RFID antenna constructed in accordance with one example embodiment of the present disclosure.
Figure 7:
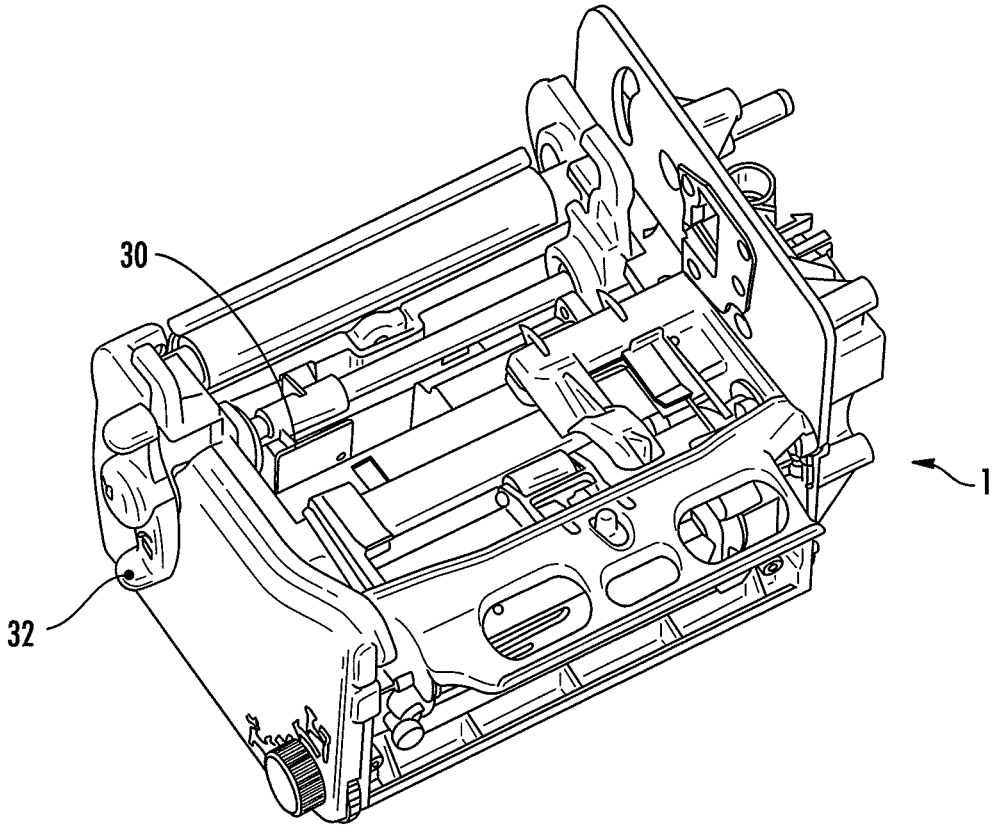
FIG. 7 is a perspective top view of an embodiment of a print station constructed in accordance with one example embodiment of the present disclosure.

In example embodiments and as best shown in FIG. 5, the printhead assembly 17 includes a thermal printhead 18, compression springs 19, a printhead pressure adjustment sensor 20 and a fan 21. The printhead pressure adjustment sensor 20 monitors, senses and determines the force within the compression springs 19. The fan 21 cools the thermal printhead 18 as needed. A temperature sensing member 22, such as a thermistor, may be located within the thermal printhead 18 to control overheating of the print station 1. The temperature sensing member 22 may be operatively coupled to a thermal heatsink to detect a thermal gradient generated therein. The temperature sensing member 22 may also be coupled to a controller in the print station 1 which may adjust the target temperature of a heating element or may deactivate the heating element. The fan 21 may also be used to cool the thermal printhead 18.

In example embodiments, the print station 1 includes a main platen roller 15 and a lower roller 16. The main platen roller 15 is utilized for printing, while the lower platen roller 16 is utilized for assisting with the rewinding of media onto the rewind hub/assembly 5.

In example embodiments, the lower platen roller 16 may be slightly overdriven to maintain a tight media web between the main platen roller 15 and the lower platen roller 16. A tight media web is preferable for separating (or peeling) the labels off its corresponding backing.

The print station 1 also includes a pinch roller 23 and a top-of-form sensor 24. The top-of-form sensor 24 may be located between the main platen roller 15 and the pinch roller 23. The pinch roller 23 may be slightly underdriven to maintain a tight media web through the top-of-form sensor 24. When the print station 1 reverses direction during use, the pinch roller 23 is then slightly overdriven in order to maintain the media web tight through the top-of-form sensor 24. A rocker arm 25 and associated gears 26 permits movement of the print media in a forward and reverse direction.

The platen rollers 15, 16 and the pinch roller 23 may be easily removed and replaced in the event they become damaged during use or abuse of the print station 1.

Figure 8:
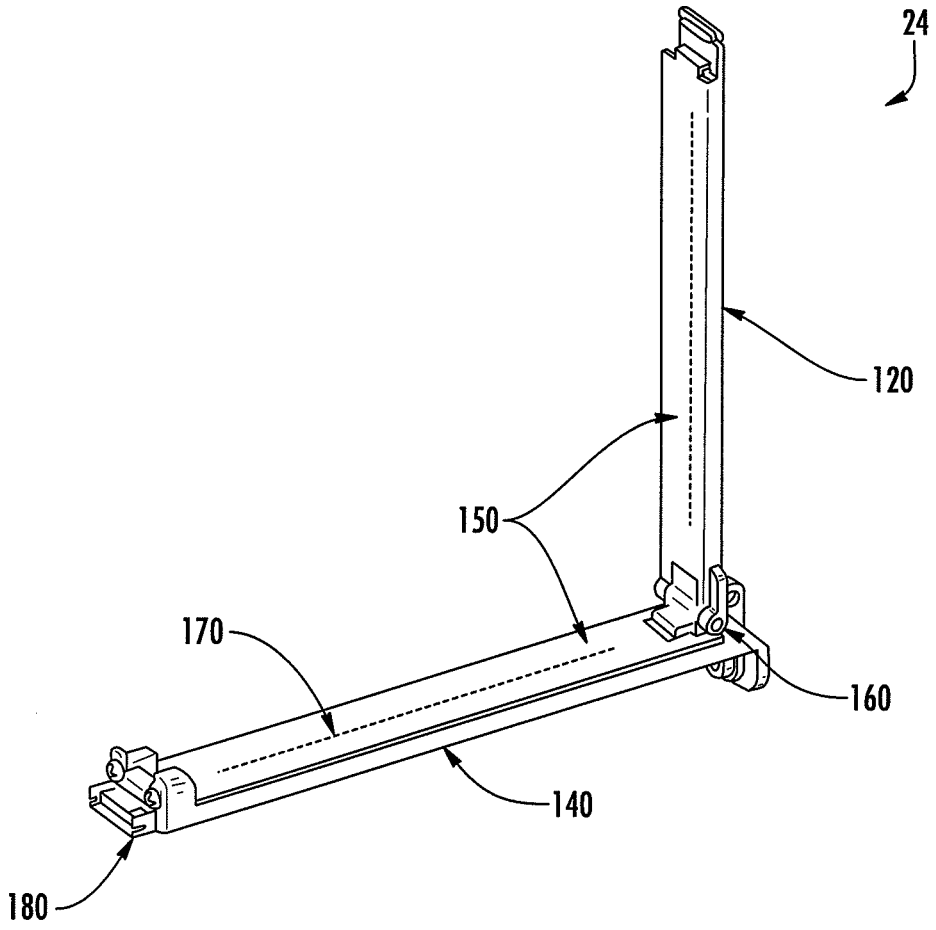
FIG. 8 is a perspective view of a top of form sensor which may be incorporated into a print station of the present disclosure.

In example embodiments, the top-of-form sensor 24 may be included in the print station 1 to determine a location of an initial portion of a web fed to the print station 1 and to properly align the printed information onto the media. The top-of-form sensor 24 may also determine and provide a signal when the initial portion of the web is located at a desired location within the print station 1. As best shown in FIG. 8 and in exemplary embodiments, a top of form sensor 24 is provided and is an optical sensor which includes a base 140 hinged to a cover 120 by a hinge 160. A flexible circuit 150 is communicably fixed to the base 140 and cover 120 and may include an array of light emitting diodes (LEDs), photo sensors, and/or other notification and sensing means 170 that permit for sensing indicators on media. The top of form sensor 24 may be capable of sensing any one of the following indicators: black marks on the top side or under side of the media, holes through or slots on the side of the media, top edges of label stock media, and any other errors, inconsistencies, or faults which may arise relative to positioning of and/or printing on the media. In exemplary embodiments, the top of form sensor 24 installed in the print station 1 and focused on a reserved area of a media web which is provided with a top of form mark. In exemplary embodiments, the sensor 24 may be connected to a printer control unit via a interface connector 180 to assist in achieving form alignment and determination of the presence of an unprinted media portion or label. The use of the interface connector 180 provides a plug-in-play type set up and allows for easy removal for maintenance of both the print station 1 and the sensor 24.

In certain example embodiments, media guides 27*a*, 27*b* are included in the print station 1 and may be located prior to the pinch roller 23 to as to guide the media along a print station 1 center line. The media guides 27*a*, 27*b* each may contain media loading sensors 28 which may be used to inform the print station 1 that media is being fed into the print station 1. Further, the sensor is used to inform the print station of the width of the media being fed through the system. The print station 1 passes the information to a printhead pressure adjustment sensor 20 located within the printhead assembly 17. The printhead pressure adjustment sensor 20 adjusts the compression springs 19 for the appropriate force setting. Further description as to the media hanger 27*a*, 27*b* is provided below.

A media adjustment knob 29 is provided to adjust the width of the media guides 27*a*, 27*b*. Further, the media adjustment knob 29 may be self-locking, which would result in no longer requiring the print station 1 to lock the media guides 27 in position.

Figure 9:
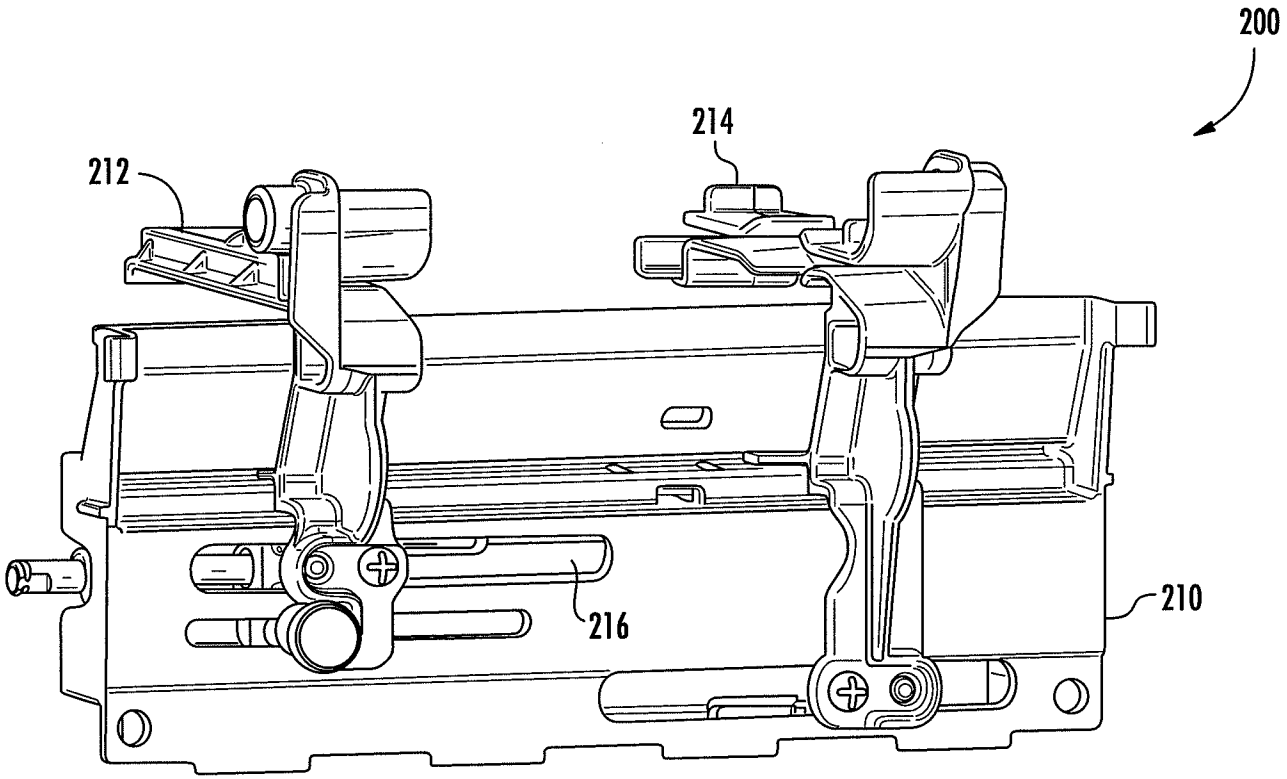
FIG. 9 is a perspective view of a media guide device which may be incorporated into a print station of the present disclosure.

Referring now to FIG. 9, an alternative example embodiment of the media guides 27*a*, 27*b* is shown. In the alternative exemplary embodiment a media width sensing apparatus 200 is provided within the printing system 10 and about the print station 1. The sensing apparatus 200 includes a pair of adjustable media guides 212, 214 connected about a carriage 210. A sensor (not shown) is provided, affixed to the carriage 210 and in signal communication with control circuitry of the printing system (not shown). The sensor is configured and operable for emitting at least one optical signal or light beam through at least one aperture 216 located in the carriage 210. At least one of the media guides 212 or 214 are provided with a tab or other obstruction (not shown) which is configured and operable for protruding into at least a portion of the path of the at least one optical signal or light beam emitted from the sensor at defined locations, the defined locations corresponding to the widths of various media types used within the printing system 10. As the media guides 212, 214 move about the horizontal axis of the carriage 210, the tab may block or otherwise interrupt or obstruct the at least one optical signal or light beam, thereby reflecting the at least one optical signal or light beam back to the sensor and thus signaling the sensor of the media's detection and width. By detecting and determining the media width in the print station 1, automatic adjustments can be made to the printhead pressure, ribbon supply tension, ribbon supply take up, and rewind tension, thereby ensuring a higher quality printed image and prolonged printer operation. Further, by detecting and determining the media width in the printer station 1, associated software can compare the width of the image to be printed to the media width and notify the operator that they may be printing off the media.

Referring back to FIGS. 3-7, a motor 14 is provided to power the print station 1. The motor 14, which may be a drive-stepper motor, is geared to the platen rollers 15, 16 such that a full step of the motor 14 corresponds to a media movement. A non-limiting example of such media movement may be $1/300^{th}$ of an inch. Continuing the non-limiting example, with a 300 dot per inch printhead assembly 17 such movement would result in a 300×300 dots per inch area of print. Additionally, the motor 14 may be operated in half-step mode. As a non-limiting example of the results achieved using the half-step mode, the same gearing would result in a corresponding movement of $1/600^{th}$ of an inch, with a 600 dot per inch printhead assembly 17 and 600×600 dots per inch area of print.

The motor 14 may be a direct current (DC) or alternative current (AC) driver motor, which may include an attached encoder disk that may be used to drive the print station 1. The print station 1 may establish a corresponding timing for 300, 600, or other dots per inch printing by determining the proper number of slots in the encoder disk.

A latch sensor 30 may be included to send a signal to the print station 1 of the position of the latches 31*a*, 31*b*. The latch sensor 30 may also sense when the latch 31*a*, 31*b* is closed, fully opened, or a variety of positions therebetween. A latch handle 32 permits manipulation of the latches 31*a*, 31*b* as desired.

The print station 1 may also include a receptacle 33 for mounting a radio-frequency identification (RFID) antenna 34. The receptacle 33 may be located prior to the main platen roller 15. The RFID antenna 34 may be used to imprint RFID data onto a chip embedded in a label. After the chip in the label is programmed with data, the label is then thermally printed. In the alternative, the RFID antenna 34 may be directly located on or incorporated in the print station 1.

Because the print station 1 is stand-alone, it may be easily inserted, removed from, or otherwise incorporated into or incorporated with a larger printer as desired, thereby permitting additional capabilities, functions, and options other than or in addition to those features provided by the print station 1.

The embodiments described above provide advantages over conventional devices and associated methods of manufacture. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Furthermore, the foregoing description of the preferred embodiment of the invention and best mode for practicing the invention are provided for the purpose of illustration only and not for the purpose of limitation—the invention being defined by the claims.

What is claimed is:

1. A print station for use with a thermal transfer printer comprising:

a housing;

a motor mounted within the housing and connected to control circuitry mounted about the housing;

a platen roller assembly configured to have a media web pass there through and being in operative communication with the motor and control circuitry;

a pinch roller in operative communication with the motor;

a top-of-form sensor located between the platen roller and the pinch roller, wherein the top-of-form sensor allows for sensing of indicators on the media web;

a rocker arm in operative communication with the platen roller and the pinch roller;

a printhead assembly;

a media width sensing and guide device having a pair of adjustable media guides and at least one media width sensor in communication with the printhead assembly for guiding the media through the system; and a radio-frequency identification antenna substantially located between the main platen roller and the pinch roller.

2. The print station of claim 1, wherein the motor is a drive stepper motor.

3. The print station of claim 1, wherein the printhead assembly comprises:

a thermal printhead;

at least one compression spring; and a printhead pressure adjustment sensor in communication with the compression spring.

4. The print station of claim 3, wherein the printhead pressure adjustment sensor monitors, senses and determines the force being applied to the compression springs during a printing operation.

5. The print station of claim 1, wherein the platen roller assembly is comprised of a main platen roller and a lower platen roller and wherein the main platen roller is configured for printing operations and the lower platen roller is configured for assisting with the rewinding of media into a rewind hub of the printing system.

6. The print station of claim 5, wherein the lower platen roller may be slightly overdriven during a printing operation to maintain a tight media web.

7. The print station of claim 1, wherein the pinch roller may be underdriven by the motor during a printing operation to maintain a tight media web through the top of form sensor.

8. The print station of claim 1, wherein the top of form sensor is an optical sensor.

9. The print station of claim 8, wherein the top of form sensor is comprised of a base hingedly fixed to a cover, a flexible circuit communicably fixed to the base and cover and an interface connector communicably connected to the control circuitry, wherein the flexible circuit comprises a plurality of sensing means that permit the sensing of indicators on media.

10. The print station of claim 9, wherein the plurality of sensing means are light emitting diodes and photo sensors.

11. The print station of claim 1 further comprising a latch sensor configured for sensing information relating to the position of the housing and communicating the information to the control circuitry.

12. An image forming device operable for easy installation and removal from a thermal transfer printer, comprising:

a motor mounted within a housing and being connected to control circuitry mounted about the housing;

a platen roller assembly configured to have a media web pass there through and being in operative communication with the motor and control circuitry;

a pinch roller in operative communication with the motor;

a top-of-form sensor located between the platen roller and the pinch roller, wherein the top-of-form sensor allows for sensing of indicators on the media web;

a rocker arm in operative communication with the platen roller and the pinch roller;

a printhead assembly;

a media width sensing and guide device having a pair of adjustable media guides and at least one media width sensor in communication with the printhead assembly for guiding the media through the system;

and a radio-frequency identification antenna substantially located between the main platen roller and the pinch roller.

13. The image forming device of claim 12, wherein the printhead assembly comprises:

a thermal printhead;

at least one compression spring;

and a printhead pressure adjustment sensor in communication with the compression spring.

14. The image forming device on of claim 13, wherein the printhead pressure adjustment sensor monitors, senses and determines the force being applied to the compression springs during a printing operation.

15. The image forming device of claim 12, wherein the platen roller assembly is comprised of a main platen roller and a lower platen roller and wherein the main platen roller is configured for printing operations and the lower platen roller is configured for assisting with the rewinding of media into a rewind hub of the printing system.

16. The image forming device of claim 15, wherein the lower platen roller may be slightly overdriven during a printing operation to maintain a tight media web.

17. The image forming device of claim 12, wherein the pinch roller may be underdriven by the motor during a printing operation to maintain a tight media web through the top of form sensor.

18. The image forming device of claim 12, wherein the top of form sensor is an optical sensor.

19. The image forming device of claim 12, wherein the top of form sensor is comprised of a base hingedly fixed to a cover, a flexible circuit communicably fixed to the base and cover and an interface connector communicably connected to the control circuitry, wherein the flexible circuit comprises a plurality of sensing means that permit the sensing of indicators on media.

20. An print station operable for easy installation and removal from a thermal transfer printer, comprising:

a motor mounted within a housing and being connected to control circuitry mounted about the housing;

a platen roller assembly configured to have a media web pass there through and being in operative communication with the motor and control circuitry;

a pinch roller in operative communication with the motor;

a top-of-form sensor located between the platen roller and the pinch roller, wherein the top-of-form sensor allows for sensing of indicators on the media web;

a rocker arm in operative communication with the platen roller and the pinch roller;

a printhead assembly, said printhead assembly comprising a thermal printhead, at least one compression spring, and a printhead pressure adjustment sensor in communication with the compression spring;

a media width sensing and guide device having a pair of adjustable media guides and at least one media width sensor in communication with the printhead assembly for guiding the media through the system; and a radio-frequency identification antenna substantially located between the main platen roller and the pinch roller.

* * * * *